United States Patent [19]

Ellis

[11] 4,168,818

[45] Sep. 25, 1979

[54] BRACKETS FOR OUTBOARD MOTORS

[76] Inventor: Brain A. J. Ellis, 62 Hilton Rd., Maperley, Nottingham, England

[21] Appl. No.: 814,162

[22] Filed: Jul. 11, 1977

[30] Foreign Application Priority Data

Jul. 14, 1976 [GB] United Kingdom ..... 29262/76

[51] Int. Cl.[2] ..... B63H 21/26

[52] U.S. Cl. ..... 248/640; 115/17

[58] Field of Search ..... 248/4, 284, 281; 115/17, 18, 41

[56] References Cited

U.S. PATENT DOCUMENTS

| | | | |
|---|---|---|---|
| 806,790 | 12/1905 | Foersterling | 248/281 |
| 1,686,341 | 10/1928 | Nathanson | 248/281 X |
| 3,426,190 | 2/1969 | Bobrick | 248/281 X |
| 3,462,102 | 8/1969 | Rivers | 248/4 |
| 3,567,164 | 3/1971 | Hakala | 248/4 |
| 3,990,660 | 11/1976 | Pipoz | 248/4 |
| 4,013,249 | 3/1977 | Meyer | 115/17 |

FOREIGN PATENT DOCUMENTS

| | | | |
|---|---|---|---|
| 670396 | 9/1963 | Canada | 248/281 |
| 672990 | 10/1963 | Canada | 248/4 |

*Primary Examiner*—J. Franklin Foss
*Attorney, Agent, or Firm*—Alan H. Levine

[57] ABSTRACT

A bracket for mounting an outboard motor on a boat, said bracket comprising a parallel linkage arrangement for moving the motor between respective end positions above and below the boat and a latch arrangement for latching an operating lever in either end position. The latch arrangement is released by a force applied manually in a direction from the bracket towards the boat. The load on the bracket is preferably prevented from bearing on the latch arrangement and PTFE washers are used for tight fitting of the linkage without jamming.

10 Claims, 2 Drawing Figures

BRACKETS FOR OUTBOARD MOTORS

This invention relates to brackets for outboard motors, i.e. brackets which are adapted to be mounted on a boat and so to mount a motor that it can be lowered into, or raised out of the water.

According to the present invention there is provided a bracket for an outboard motor comprising a first bracket assembly adapted to be mounted on a boat, a second bracket assembly adapted to mount a motor, at least two links in a spaced apart parallel relationship pivotally mounted on, and interconnecting the bracket assemblies for movement, in use, of said second bracket assembly and thus the motor relative to said first bracket assembly between respective end positions above and below said first bracket assembly, and an operating lever having a latch arrangement and a manually operable handle arrangement, the latch arrangement being arranged to latch the lever in either of two positions and release the lever for movement between said two positions on the application of a force in a direction towards said first bracket assembly against a biasing force.

Preferably the operating lever is pivotally mounted at or adjacent to one end on one of said links and is connected with the other of said links by means of the latch arrangement. The biasing force may be provided by a tension spring which extends between the operating lever and a pin on said second bracket assembly, respective ones of the links being engageable with said pin in the respective end position of said second bracket assembly so as to direct the load applied to the bracket on to the pin and not on to the latch arrangement.

Preferably also the pin mounts a pair of bushes, preferably nylon, which bear the applied load and define a central groove the biasing spring having one end in the central groove.

The pin may be positioned substantially centrally between the pivots for the links on said second bracket assembly and the biasing spring may extend substantially parallel to the links.

Advantageously said one link is defined by a pair of parallel blades and pivots are provided therefor on said first and second bracket assemblies, the parallel blades being spaced apart axially on the pivots, the operating lever is defined by a pair of parallel blades spaced apart axially on a pin extending between the blades of said one link and defining a pivot for the operating lever, and the other link is defined by a single blade extending between the blades of the operating lever and having a projection on each side thereof extending into shaped openings in the respective blades of the operating lever so as to define the latch arrangement.

Preferably the pivots for the links are defined by pins which mount bushes, preferably of nylon, and washers, preferably of polytetrafluoroethylene to enable tight fitting of the pivots without jamming.

The present invention also provides a bracket for an outboard motor comprising a first bracket assembly adapted to be mounted on a boat, a second bracket assembly adapted to mount a motor, and at least two links interconnecting the bracket assemblies for movement, in use, of said second bracket assembly and thus the motor relative to said first bracket assembly between respective end positions above and below said first bracket assembly, the links being mounted on the respective bracket assemblies by means of pivots including PTFE washers which enable tight fitting of the links on the pivots without jamming.

An embodiment of the present invention will now be described by way of example only with reference to the accompanying drawings in which.

Figure 1:
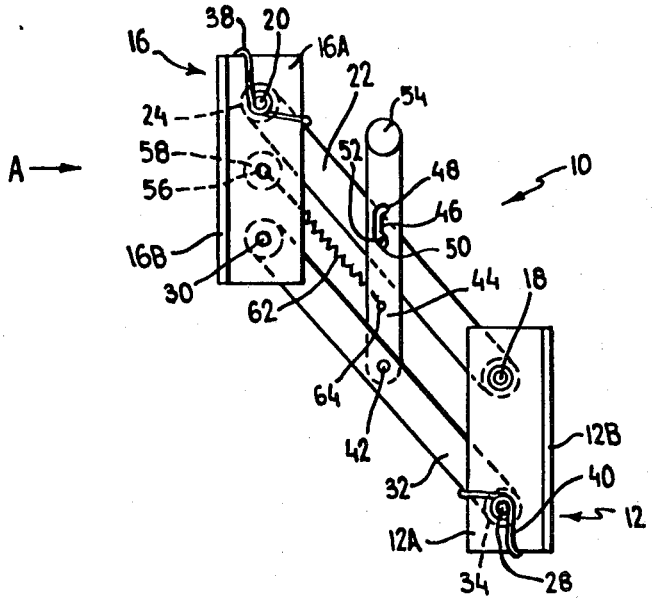
FIG. 1 is a side view of an outboard bracket according to the invention.

Referring to the drawings an outboard bracket 10 includes a first bracket assembly comprising a pair of brackets 12 formed preferably of angle aluminium and arranged to be so mounted on a boat (not shown) that the flanges 12A are retained in a parallel spaced apart relationship. The other flanges 12B are mounted on the boat by fasteners such as screws through apertures 14. A second bracket assembly comprises a pair of brackets 16 similar to the brackets 12 and adapted to be mounted by means of their flanges 16B on a block for example of marine plywood (not shown) which in turn mounts an outboard motor (not shown). The flanges 16A of the bracket 16 are retained parallel and spaced apart by the same distance as the flanges 12A of the brackets 12.

Figure 2:
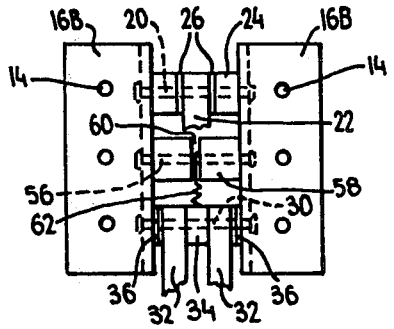
FIG. 2 is a partial end view of the bracket shown in FIG. 1 in a direction of arrow A.

At one end, the upper end as shown in FIG. 1, of each of the bracket assemblies a respective pin 18, 20 extends between the respective pair of flanges 12A, 16A. Extending between the pivot pins 18, 20 is a link in the form of a single blade 22, the latter being mounted at each end on the respective pivot pin between a pair of bushes 24 (FIG. 2), preferably formed of nylon, and a washer 26, preferably formed of PTFE, being mounted on the pivot pin between the blade 22 and each bush 24. This arrangement enables the blade 22 to be tightly positioned between the bushes 24 in order to prevent sideways flopping of the blade, without risk of jamming.

At the lower end of each of the bracket assemblies there is provided a respective pivot pin 28, 30 extending between the respective flanges 12A, 16A. A second link in the form of a pair of parallel blades 32 extends between the pivot pins 28, 30, the blades 32 being held parallel to one another and axially spaced on the pivot pins 28, 30. The blades 32 are mounted on each pivot pin between a central bush 34, preferably formed of nylon, and a pair of washers 36, preferably formed of PTFE, located adjacent to the respective flanges 12A, 16A. Again this arrangement enables a tight fitting of the blades 32 without risk of jamming.

The pivot pin 28 of the bracket 12 and the pivot pin 20 of the bracket 16 extend at either side of the respective flanges 12A, 16A to mount respective ends of torsion springs, 40, 38 which pass respectively under the blades 32 and over the blade 22.

A further pivot pin 42 extends between the blades 32 at a position substantially centrally along the length thereof and pivotally mounts one end of an operating lever 44 which comprises a pair of parallel blades spaced apart axially on the pivot pin 42.

The blades of the lever 44 extend towards the blade 22 and pass on either sides thereof. Each of the blades of lever 44 has a guide opening 46 extending generally longitudinally of the blade and having an upper end recess 48 and a lower end recess 50 for a purpose hereinafter described. At an appropriate location on the blade 22 a pin 52 projects from either side thereof to engage in a respective opening 46. At its upper end the operating lever 44 mounts a handle arrangement 54 for manual operation of the bracket.

Between the flanges 16A of the bracket 16 there extends a pin 56 parallel to and substantially midway between the pivot pins 20, 30. The pin 56 mounts a pair of bushes 58, preferably formed of nylon, and these bushes 58 define a central groove 60 in which is hooked one end of a tension spring 62. The other end of the spring 62 is hooked around a pin 64 which extends between the blades of the operating lever 44 parallel to the pivot 42.

In use the bracket 16 which mounts the outboard motor can be raised or lowered between upper and lower and positions relative to the bracket 12 by means of the parallel linkage defined by the blades 22 and 32 on their respective pivots. The pin 52 of the blade 22 located in the opening 46 in the blades of the operating lever 44 defines a latch arrangement which enables the bracket 16 to be latched in its upper position when the pin 52 is in the lower recesses 50 of the openings 46 and the bracket 16 to be retained in its lower end position when the pin 52 is removed from the recesses 50 and lowering of the outboard motor causes the pin 52 to move into the upper recesses 48. The spring 62 biases the lever 44 into its latched position and thus to effect movement of the bracket 16 and therefore the out-board motor it is necessary to apply a force by moving by hand the handle 54 of the operating lever 44 in a direction towards the bracket 12 and therefore towards the boat such that the pin 52 moves out of the respective end recesses. This arrangement of the handle obviates any problems which can occur when the operating lever has to be moved in the other direction and can thus become difficult to operate when located close to bolts which secure the outboard motor to its mounting board. The arrangement also obviates the difficulties which can occur when the operating lever has to be moved in a direction away from the boat and the bracket moves to its upper end position with the hand still on the handle of the operating lever. Further in some prior outboard brackets any adjustment for increase in the lift required for the outboard motor would result in the operating lever handle being extremely close to the operating handle for the outboard motor.

The arrangement of the pin 56 is such that when the outboard motor is moved to its upper end position the blade 22 is engageable with the bushes 58 and when moved to its lower end position the blades 32 are engageable with the bushes 58, such that in the lower end position the load is taken by the pin 56 off the latch arrangement thus preventing any damage to the latter. The pin 56 also facilitates assembly of the outboard bracket as it enables the operating lever to maintain the parallel arrrangement of the blade 22 with the blades 32 due to the spring 62 being parallel with the blades. Also because of the spring arrangement it maintains a substantially constant length.

The outboard bracket is easily assembled, the biasing spring can be easily replaced without dismantling of the bracket, and the operating lever can also be easily replaced.

Various modifications may be made without departing from the invention. For example the parallel linkage need not be a three-way arrangement as described but may take the form of each link being defined by a pair of parallel blades axially spaced on the pivots. Also the operating handle can be of any form but for aesthetic qualities it preferably comprises a pin extending between the blades of the operating lever at the upper end thereof, the blades being spaced apart by a central bush and a further bush being provided on each end of the pin at the outer side of the respective blades. Such a handle is similar in appearance to the pivot arrangement. The blades are preferably formed of aluminium castings. Further a pair of tension springs may be provided instead of the single spring 62, each spring extending between outwardly projecting ends of the pins in the bracket 16 and the operating lever 44. A further load bearing pin may be provided on the bracket 16 for engagement by the blades 32 in the lower end position of the bracket. Torsion springs may be provided on each of the pins 18, 30 for engagement with the blades 22 and 32 respectively.

I claim:

1. A bracket for an outboard motor comprising a first bracket assembly adapted to be mounted on a boat, a second bracket assembly adapted to mount a motor, at least two links in a spaced apart parallel relationship pivotally mounted on, and interconnecting the bracket assemblies for movement, in use, of said second bracket assembly and thus the motor relative to said first bracket assembly between respective end positions above and below said first assembly, an operating lever having a latch arrangement and a manually operable handle arrangement, the latch arrangement being arranged to latch the lever in either of the two end positions, a pin on said second bracket assembly, and a spring extending between the operating lever and said pin for biasing said lever in a direction for latching the latch arrangement, said pin being so located that it rests upon one of said links and carries the weight of the motor when said second bracket assembly is latched in its end position below said first bracket assembly.

2. A bracket according to claim 1, wherein the operating lever is pivotally mounted adjacent to one end on one of said links and is connected with the other of said links by means of the latch arrangement.

3. A bracket according to claim 1 wherein the latch arrangement and spring are so mutually arranged that the lever is moved toward said first bracket, against the force of the spring, to unlatch the lever in each end position of said second bracket assembly.

4. A bracket according to claim 1, wherein the pin mounts a pair of bushes, which bear the applied weight and define a central groove, the biasing spring having one end mounted in the central groove.

5. A bracket according to claim 4, wherein the bushes are formed of nylon.

6. A bracket according to claim 4, wherein the pin is positioned substantially centrally between the pivots for the links on said second bracket assembly and the biasing spring extends substantially parallel to the links.

7. A bracket according to claim 1, wherein a pair of tension springs which extend between the operating lever and a pin on said second bracket assembly, provide the biasing force, a further pin being provided on said second bracket assembly parallel to said first mentioned pin, the links being engageable with a respective one of the pins in the respective end position of said second bracket assembly so as to direct the load applied to the bracket on to the pins and not to the latch arrangement.

8. A bracket according to claim 7, wherein the tension springs extend substantially parallel to the links.

9. A bracket according to claim 2, wherein said one link is defined by a pair of parallel blades and pivots are provided therefor on said first and second bracket assemblies, the parallel blades being spaced apart axially on the pivots, the operating lever is defined by a pair of parallel blades spaced apart axially on a pin extending between the blades of said one link and defining a pivot for the operating lever, said operating lever blades having means defining shaped openings therein, and the other link is defined by a single blade extending between the blades of the operating lever and having a projection on each side thereof extending into the shaped opening in the respective blade of the operating lever so as to define the latch arrangement.

10. A bracket according to claim 9, wherein the pivots for the links are defined by pins which mount nylon bushes and PTFE washers, to enable tight fitting of the pivots without jamming.

* * * * *